US006396451B1

(12) United States Patent
Wu et al.

(10) Patent No.: US 6,396,451 B1
(45) Date of Patent: May 28, 2002

(54) PRECISION MULTI-LAYER GRIDS FABRICATION TECHNIQUE

(75) Inventors: Te-Kao Wu, Rancho Palos Verdes; Sundeep Puri, Canoga Park, both of CA (US)

(73) Assignee: TRW Inc., Redondo Beach, CA (US)

( * ) Notice: Subject to any disclaimer, the term of this patent is extended or adjusted under 35 U.S.C. 154(b) by 0 days.

(21) Appl. No.: 09/860,104

(22) Filed: May 17, 2001

(51) Int. Cl.[7] ..... H01Q 19/00
(52) U.S. Cl. ..... 343/756; 343/909
(58) Field of Search ..... 343/756, 872, 343/909, 753, 754, 893, 912, 841, 725

(56) References Cited

U.S. PATENT DOCUMENTS 5,140,338 A * 8/1992 Schmier et al. ..... 343/909
5,373,302 A * 12/1994 Wu ..... 343/781 P
5,400,043 A * 3/1995 Arceneaux et al. ..... 343/872
5,497,169 A * 3/1996 Wu ..... 343/909
5,600,325 A * 2/1997 Whelan et al. ..... 342/13
5,917,458 A * 6/1999 Ho et al. ..... 343/909
5,949,387 A 9/1999 Wu et al.
5,959,594 A 9/1999 Wu et al.
6,198,457 B1 * 3/2001 Walker et al. ..... 343/840
6,208,316 B1 * 3/2001 Cahill ..... 343/909
6,232,931 B1 * 5/2001 Hart ..... 343/909
6,323,825 B1 * 11/2001 Zidek et al. ..... 343/872

OTHER PUBLICATIONS

"Design of a Dichroic Cassegrain Subreflector", Vishwani D. Agrawal and William A. Imbriale, IEEE Transactions on Antennas and Propagation, vol. AP–27, No. 4, Jul., 1979, pp. 466–473.

"Meander–Line Polarizer", Leo Young, Lloyd A. Robinson, and Colin A. Hacking, IEEE Transactions on Antennas and Propagation, May, 1973, pp. 376–378.

* cited by examiner

*Primary Examiner*—Tho Phan
*Assistant Examiner*—Shih-Chao Chen
(74) *Attorney, Agent, or Firm*—McAndrews, Held & Malloy, Ltd.

(57) ABSTRACT

A multi-layer grid (20) for an antenna system (10). The multi-layer grid 20 includes a first panel (22) and a second panel (24). Each panel is formed utilizing a pair of outer layers (26, 28) which are adhered to a dielectric foam (30). A low loss adhesive layer (32, 34) enables bonding of dielectric foam (30) to each of respective outer layers (26, 28). A spacer (38) provides a predetermined spacing between first panel (22) and second panel (24). A frequency selective surface filter (38) is disposed on the outer layer (28) of each panel (22, 24).

17 Claims, 3 Drawing Sheets

PRECISION MULTI-LAYER GRIDS FABRICATION TECHNIQUE

BACKGROUND OF THE INVENTION

1. Technical Field

The present invention relates generally to fabrication of multi-layer grids and, more particularly, to fabrication of multi-layer grids for frequency selective surfaces of an antenna.

2. Discussion

Frequency selective surfaces (FSSs) have been used in connection with wireless transmission systems such as antenna systems to reject the transmission of signals at a selected frequency band while allowing signals in a select frequency band to pass through the frequency selective surface. Accordingly, the frequency selective surface can advantageously be used to filter out signals at certain frequencies. Frequency selective surfaces are especially useful for satellite antenna systems where multiple signals at different frequencies may be present, but only selected frequency signals are to be transmitted to and from a given antenna system.

Known frequency selective surfaces have generally consisted of an array of conductive elements fabricated on a dielectric medium. The dielectric medium is generally transparent to signal radiation, while the conductive elements are configured to selectively allow signals of certain frequencies to pass through and reject signals at other frequencies. Typically, the conductive elements are often configured as closed loops, square loops, or circular loops. Generally speaking, the dimensions of the conductive elements determine the passband and rejection band of the frequency selective surface. The use of an array of conventional, single conductive loops of identical size and shapes will provide a single narrow band of rejection. However, the single loop configuration provides only limited signal rejection and a rather narrow frequency rejection band.

A double-loop frequency selective surface has also been used in connection with a dual-reflector antenna. One example of such a double-loop frequency selective surface is described in U.S. Pat. No. 5,373,302, entitled "Double-Loop Frequency Selective Surfaces for Multi Frequency Division Multiplexing in a Dual Reflector Antenna," issued to Wu on Dec. 13, 1994. The aforementioned issued U.S. patent is incorporated herein by reference. The double-loop frequency selective configuration provides an array of two different size conductive loop elements on a sub-reflector which reflects signals at two different frequency bands back into a main reflector. While dual frequency reflection bands are obtainable, each of the reflection bands effectively reflects the signals over a narrow range of frequencies.

More recently, multibeam phased array antennas have been developed especially for use on a satellite system which can be operated at various operating frequencies. For example, in a multi-band communications system, a transmit antenna may be operable to transmit signals at frequencies in the K-band such as 20.2 to 21.1 GHz, while a receive antenna may be operable to receive signals at frequencies in the Q-band such as 41 GHz. Crosslink communications among satellites may operate at frequencies in the V-band such as 62.2 GHz. One problem that may arise with the transmit antenna is that the antenna's transmit circuit can generally employ power amplifiers which exhibit non-linear characteristics. These non-linear power amplifiers as well as other non-linear circuits which are commonly provided in active antennas may produce high frequency second and third harmonics. The high frequency second and third harmonics generated by the transmitter can interfere with the receive and crosslink channels, unless adequate signal filtering signal is provided. Such a filtering device for satellite systems and the like is generally required to be small and as light weigh as possible.

More recently, a frequency selective surface providing both signal passing and signal rejection at multiple frequency bands has been used in connection with antennas. An example of such a frequency selective surface is described in U.S. Pat. No. 5,949,387, entitled "Frequency Selective Surface (FSS) Filter for an Antenna", issued to Wu et al. on Sep. 7, 1999. The aforementioned issued U.S. patent is incorporated herein by reference. The frequency selective surface filter for an antenna filters out the unwanted signals caused by the amplifier's high frequency harmonics, especially with the transmit antenna. The frequency selective surface filter has either a single or a double conductive screen disposed on a dielectric substrate. The screen includes a grid having conductive elements which reject specific frequencies and pass other selected frequencies.

More generally, satellite antenna systems require extreme accuracy, low mass, and low costs. Such desirable qualities are often achieved by utilizing high performance multi-layer grid components, such as patch radiating arrays, polarizers, and frequency selective surface (FSS) filers. Conventionally fabricated devices, for space flight components, however, have typically used epoxy resins which often have a loss tangent of greater than 0.06. Such parts also typically utilize Kevlar™ honeycomb core materials at frequencies lower than 10 GHz. At higher frequencies, such as 24.0 to 40.0 GHz, the Ka-band, 40.0 to 50.0 GHz, the Q-band, and 50.0–70.0 GHz, the V-band, the loss tangent of epoxy resins prove to be too great such that they cannot be utilized. Further, multi-layer grid components which utilize Kevlar™ also exhibit very large loss tangent values and typically exhibit anisotropic properties. Thus, the assembly of multi-layer grids using epoxy resin and honeycomb core has relatively poor repeatability and provides performance inferior to what is generally desired. For example, for a V-band FSS, the wavelength is less than 0.5 cm, and the control and accuracy of layer spacing and adhesive thickness becomes critical in the fabrication process. The accuracy requirement for such layer spacing is 0.001". The epoxy and honeycomb approach for building such an FSS does not meet such a high standard.

Thus, it is desirable to provide a low loss, low mass, space qualified material for fabrication of multi-layer grids and a repeatable process for fabrication of multi-layer grids.

SUMMARY OF THE INVENTION

The present invention is directed to a multi-layer grid for a frequency selective surface filter of an antenna. The multi-layer grid includes a first panel defining a first layer and further includes a first outer film and a first isotropic foam spacer bonded to the first outer film. A first adhesive layer bonds the foam spacer to the first outer film. A second outer film is bonded to the first foam spacer opposite the first outer film and a second adhesive layer bonds the foam spacer to the second outer film. The multi-layer grid further includes a second panel defining a second layer and having a third outer film and a second isotropic foam spacer bonded to the third outer film. A third adhesive layer bonds the foam spacer to the third outer film. A fourth outer film bonds to the second foam spacer opposite the third outer film, and a fourth adhesive layer bonds the foam spacer to the fourth outer film. A spacer inserted between the first and second panels integrates the first and second set of grids.

For a more complete understanding of the invention, its objects and advantages, reference should be made to the following specification and to the accompanying drawings.

BRIEF DESCRIPTION OF THE DRAWINGS

The drawings, which form an integral part of the specification, are to be read in conjunction therewith, and like reference numerals are employed to designate identical components in the various views.

DESCRIPTION OF THE PREFERRED EMBODIMENT

Figure 1:
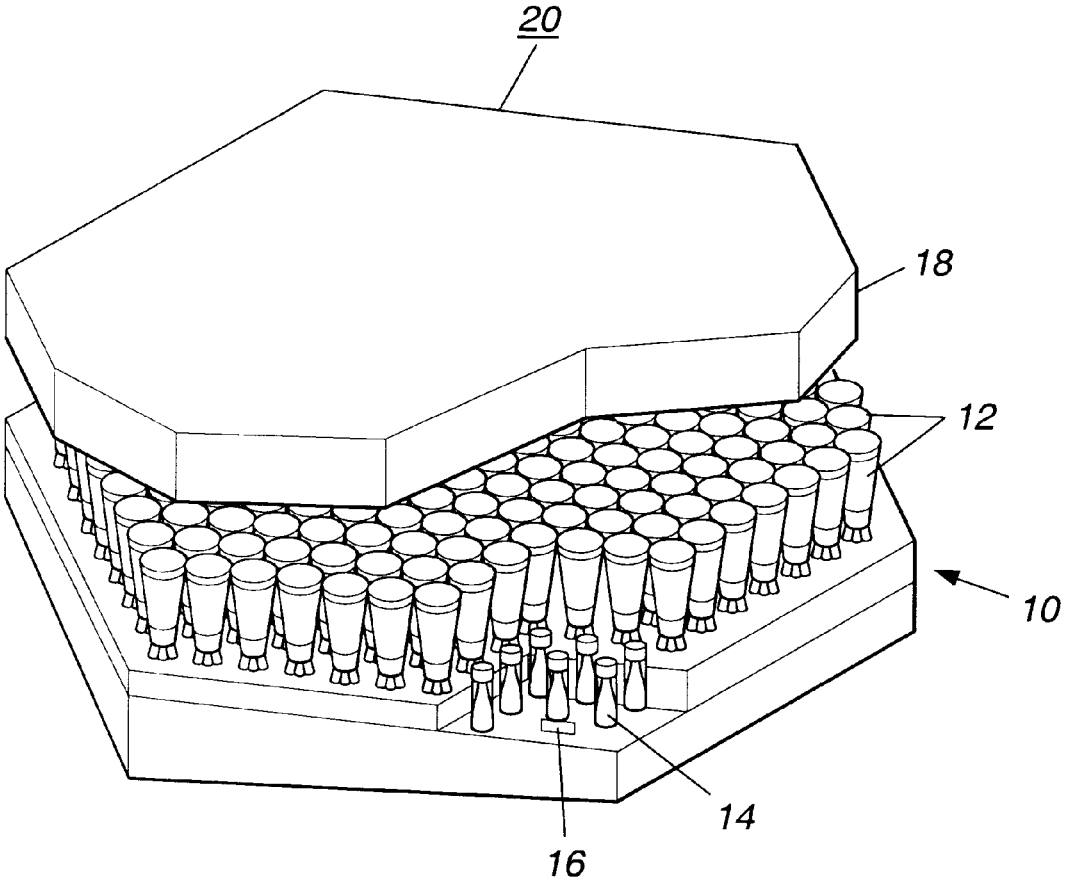
FIG. 1 is a partial cut-away view of a multi-beam phase array transmit antenna having a multi-layer grid.

With reference to FIG. 1, a multibeam phased array transmit antenna 10 is shown with a frequency selective surface (FSS) 20 arranged in accordance with the principles of the present invention. The multibeam phase array antenna 10 is particularly suited for use in connection with a satellite communications system which may include both transmit and receive antennas for communicating with ground based communications systems. By way of example, antenna may be operable for transmitting signals having frequencies of approximately 20.2 to 21.2 GHz, within the K-band, while the receive antenna may be operable to receive signals having frequencies of approximately 40.4 to 45.5 GHz within the Q-band. In addition, satellite communications system may include antennas for transmitting and receiving crosslink communications signals among various satellites of frequencies of approximately 60.6 to 60.6 GHz, within the V-band. The phased array antenna 10 is shown and explained in connection with the present invention is a transmit antenna. However, it should be appreciated that the multi-layer grids described herein may be applicable for use in connection with various commercial and military antenna and radome systems for both receive and transmit antennas, and the frequency bands of operation by be scaled to other frequency bands, without departing from the principles of the present invention.

The multibeam phased array antenna 10 as shown includes an array of medalized, plastic feed horns 12 configured side-by-side in a planar arrangement. However, antenna 10 may include a single radiating element or multiple radiating elements configured in various other configurations including a curved configuration. Antenna 10 described herein is a transmit antenna for transmitting transmit signals at frequencies of 20.2 to 21.2 GHz within the K-band. The antenna 10 includes a circular-to-rectangular transition element 14 and a beam forming network with amplifiers 16. In addition, the multibeam phase array antenna 10 may include a linear-to-circular polarizer 18 disposed at the output of feed horns 12. The frequency selective surface filter 20 rejects signals at a predetermined frequency in order to prevent certain frequencies from interfering with other antenna operations.

Figure 2:
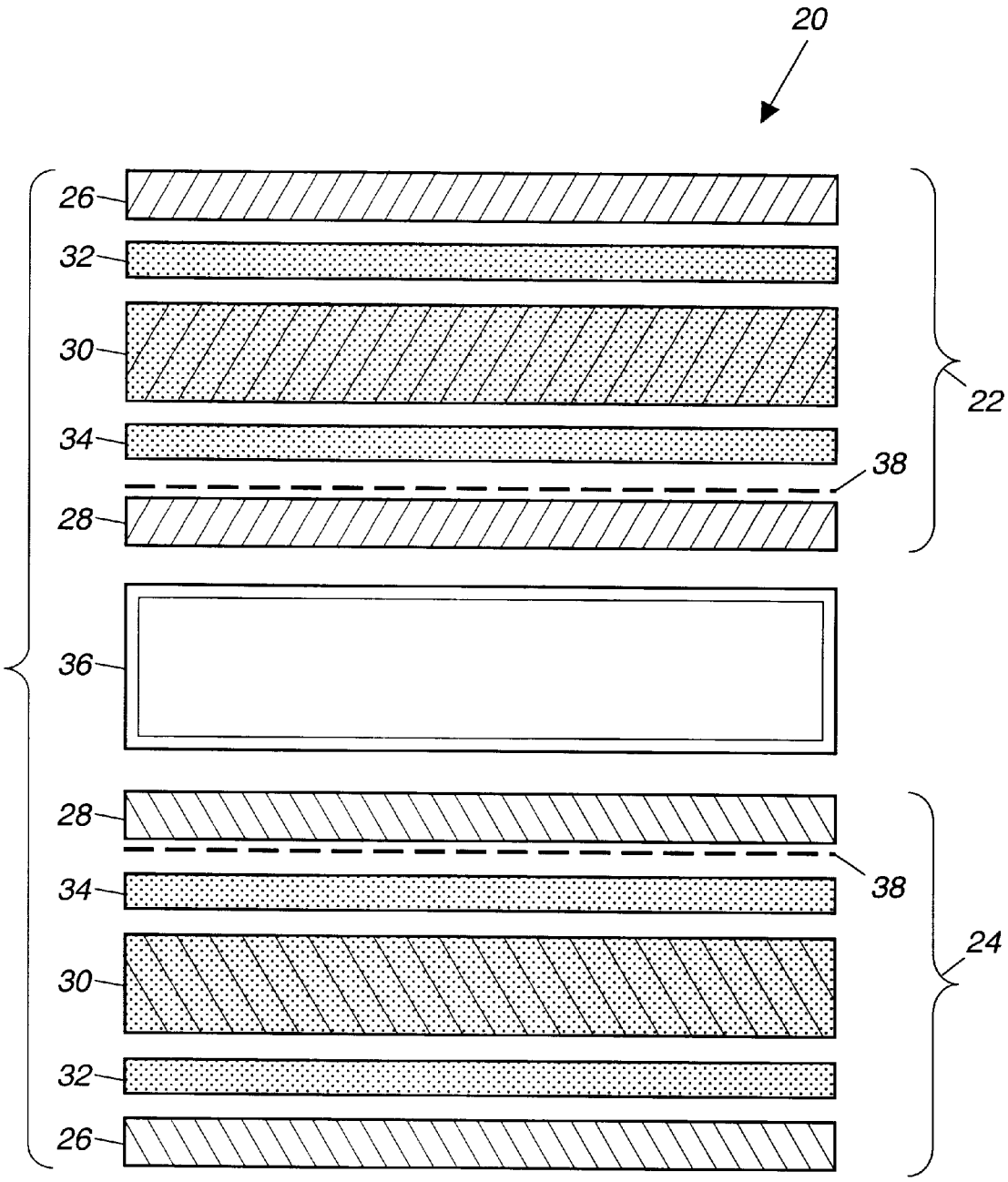
FIG. 2 is a cross-sectional view of a multi-layer grid arranged in accordance with the principles of the present invention.

FIG. 2 depicts a cross-sectional view of multi-layer grid 20 which will be utilized to implement a frequency selective surface (FSS) or other antenna components, such as multi-layer printed circuit grids. Multi-layer grid 20 is formed of a pair of panels or layers, namely, first panel or layer 22 and second panel or layer 24. As described herein, the panels are similarly configured and oriented slightly different. Each panel, however, need not be exactly the same and may be configured in accordance with specific design considerations of the functions to be effected by each panel or the composite function of a plurality of panels.

With reference to panel 22, panel 22 includes a pair of outer layers 26, 28 which are formed of a dielectric material, such as a known thin, space-qualified material such as polyimide or other suitable material. One known dielectric is identified as Kapton, which is manufactured by E.I. duPont de Nemours and Company, Inc. As shown herein, outer layers 26, 28 are formed by 0.002 inches thick Kapton. Outer layers 26, 28 as described herein have a dielectric constant of 3.2 and a loss tangent of 0.002.

Outer layers 26, 28 surround a dielectric foam 30. Outer layers 26, 28 are bonded to dielectric foam 30 utilizing a pair of respective adhesive layers 32, 34. dielectric foam 30 is a light-weight rigid, low loss material. More particularly, dielectric foam 30 is preferably an isotropic foam material, such as polymethacrylimide foam or ceramic foam. Such material preferably provides the desired isotropic and low loss properties while being light-weight and rigid. An example of such a material would be WF71 Rohacell foam manufactured by Richmond Aircraft Corporation. As embodied herein, dielectric foam 30 may be formed by using the above-mentioned Roachell foam at a thickness of 186.6 mils. As described herein dielectric foam 30 has a dielectric constant of 1.12 and a loss tangent of 0.001. dielectric foam 30 is bonded to respective outer layers 26, 28 utilizing a suitable adhesive, such as RS4LT adhesive manufactured by YLA Incorporated. Such adhesive may be formed to a thickness of approximately 1 mil. As described herein, adhesive layers 32, 34 have a dielectric constant of 4.6 and a loss tangent of 0.0013.

Outer layer 28 preferably is formed with a conductive grid or screen 38 formed on a side facing adhesive layer 34. Such a grid or screen, which will be described in greater detail herein, preferably implements an FSS filter function as described above. A rigid frame 36 interconnects first panel 22 and second panel 24. Frame 36 is preferably a rigid frame spacer and is configured to provide and maintain a predetermined spacing between panels 22, 24. Such spacing may be varied in accordance with particular design considerations. Frame spacer 36 preferably is formed of a rigid plastic material such as polycarbonate or fiberglass.

As shown in FIG. 2, first panel 22 is oriented with outer layer 26 facing upward, while second panel 24 is oriented with outer layer 26 facing downward. Such reverse orientation causes grids 38 to face opposite directions. The orientation of second panel 24 causes grid 38 of panel 24 face downward with respect to multi-layer grid 20. It should be understood that differing orientations may be implemented in accordance with specific functions to be achieved.

Figure 3:
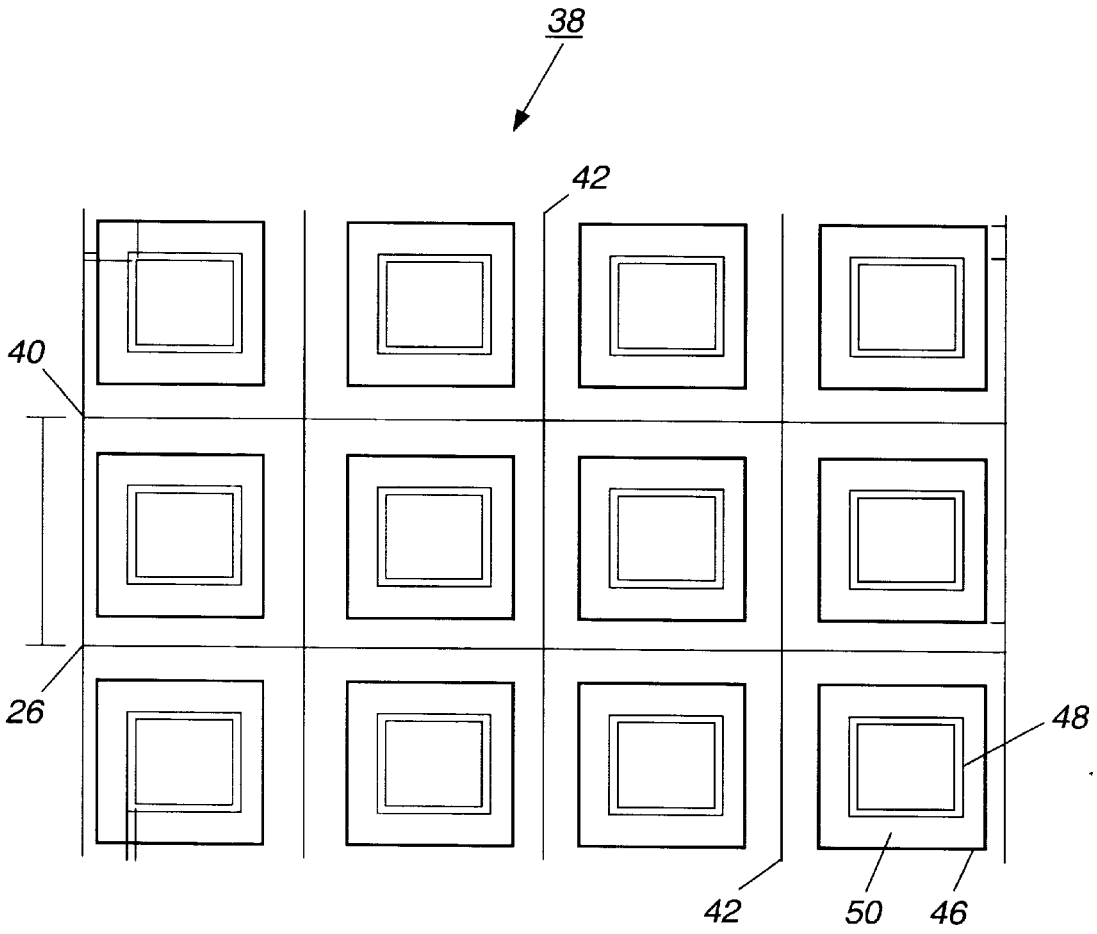
FIG. 3 is a top view of a portion of a frequency selective surface filter disposed on the multi-layer grid of FIG. 2.

With reference to FIG. 3, FIG. 3 depicts a configuration of a conductive screen or grid 38 such as may be attached to either layer of outer layers 28 to enable implementation of a frequency selective filter formed on either or both of first panel 22 and second panel 24. Grid 38 includes a gridded square array made up of a first plurality of parallel conductive lines 40 perpendicularly intersecting a second plurality of parallel conductive lines 42. The gridded square array provides for a plurality of square regions separated by the perpendicularly intersecting conductive lines 40, 42. In effect, the grid square array of conductive lines 40, 42 provides a low frequency rejection band which advantageously filters out low frequency signals.

Antenna 10 further includes an array of conductive elements, such as double loop or cross dipole, provided in the square regions. The double-loop conductive elements is made up of an inner conductive loop 48 configured within an outer conductive loop 46. The inner and outer conductive square loops 46, 48 are separated by a non-conductive isolation loop 50. Outer conductive square loop 48 is separated from conductive grid lines 40, 42 via a non-conductive region. Thus, inner conductive square loop 48 is dielectrically separated from outer conductive square loop 46.

The array of double-loop conductive elements made up of conductive loops 46 and 48 provides a first frequency rejection band and a second frequency rejection band. The inner conductive square loop 48 is configured with an outer conductive circumference of a distance equal to or close to the wavelength of signals to be rejected by inner conductive square loop 48. Similarly, the outer conductive square loop 46 has an outer conductive circumference configured of a distance approximately equal to or close to the wavelength of signals that are to be rejected with the outer conductive square loop 46. The distance of the circumference of each of conductive square loops 46 and 48 is equal to the wavelength of a frequency substantially centered in the first and second rejection bands. Depending on the widths of conductive loops 46 and 48, respectively, and the attenuation acceptance, the first and second rejection band extends over a range of frequencies in a rejection bandwidth.

The multi-layer grid 20 of the present invention offers several benefits. Utilizing polymethacrylimide foam or ceramic foam for dielectric foam 30 provides a light weight, low loss isotropic substrate. Further, utilizing the polycyanate film adhesive significantly reduces the signal loss. The isotropic property of the polymethacrylimide foam or ceramic foam further enhances the opportunity for improved polarization by providing more symmetric performance.

While the invention has been described in its presently preferred form, it is to be understood that there are numerous applications and implementations for the present invention. Accordingly, the invention is capable of modification and changes without departing from the spirit of the invention as set forth in the appended claims.

What is claimed is:

1. A multi-layer grid for a frequency selective surface filter of an antenna comprising:

a first panel defining a first layer and including:
- a first outer film;
- a first isotropic foam spacer bonded to the first outer film;
- a first adhesive layer for bonding the foam spacer to the first outer film;
- a second outer film bonded to the first foam spacer opposite the first outer film; and
- a second adhesive layer for bonding the foam spacer to the second outer film;

a second panel defining a second layer and including:
- a third outer film;
- a second isotropic foam spacer bonded to the third outer film; and
- a third adhesive layer for bonding the foam spacer to the third outer film;
- a fourth outer film bonded to the second foam spacer opposite the third outer film; and
- a fourth adhesive layer for bonding the foam spacer to the fourth outer film; and a rigid spacer inserted between the first and second panels, the spacer integrates the first and second panels.

2. The multi-layer grid of claim 1 wherein the first and second isotropic foam spacers each comprise one of polymethacrylimide foam and ceramic foam.

3. The multi-layer grid of claim 1 wherein the first and second isotropic foam spacers each comprise a foam material of uniform cross-section.

4. The multi-layer grid of claim 1 wherein the first, second, third, and fourth adhesive layers comprise polycyanate film.

5. The multi-layer grid of claim 1 wherein the rigid spacer is a rigid frame.

6. The multi-layer grid of claim 1 further comprising:

a first conducive grid disposed on the second outer film for providing a first frequency rejection band; and a second conductive grid disposed on the third outer film for providing a second frequency rejection band.

7. A multi-layer grid for a frequency selective surface filter of an antenna comprising:

a first panel defining a first layer and including:
- a first outer film;
- a first isotropic foam spacer comprised of one of polymethacrylimide foam and ceramic foam bonded to the first outer film;
- a first adhesive layer for bonding the first foam spacer to the first outer film;
- a second outer film bonded to the first foam spacer opposite the first outer film; and
- a second adhesive layer for bonding the first foam spacer to the second outer film;

a second panel defining a second layer and including:
- a third outer film;
- a second isotropic foam spacer comprised of one of polymethacrylimide foam and ceramic foam bonded to the third outer film; and
- a third adhesive layer for bonding the second foam spacer to the third outer film;
- a fourth outer film bonded to the second foam spacer opposite the third outer film; and
- a fourth adhesive layer for bonding the second foam spacer to the fourth outer film; and a rigid spacer inserted between the first and second panels, the spacer integrates the first and second panels.

8. A multi-layer grid for a frequency selective surface filter of an antenna comprising:

a first panel defining a first layer and including:
- a first outer film;
- a first isotropic foam spacer comprised of one of polymethacrylimide foam and ceramic foam bonded to the first outer film;
- a first adhesive layer for bonding the first foam spacer to the first outer film;
- a second outer film bonded to the first foam spacer opposite the first outer film; and
- a second adhesive layer for bonding the first foam spacer to the second outer film;

a second panel defining a second layer and including:
- a third outer film;
- a second isotropic foam spacer comprised of one of polymethacrylimide foam and ceramic foam bonded to the third outer film; and
- a third adhesive layer for bonding the second foam spacer to the third outer film;
- a fourth outer film bonded to the second foam spacer opposite the third outer film; and a fourth adhesive layer for bonding the second foam spacer to the fourth outer film;

a rigid spacer inserted between the first and second panels, the spacer integrates the first and second panels; and said first and second isotropic foam spacers each comprise a foam material of uniform cross-section.

9. An antenna comprising:

a radiating element for radiating electromagnetic radiation;

a circuit for one of generating and accepting signals for respective transmission by and receipt by the radiating element; and a multi-layer grid for a frequency selective surface filter disposed in communication with the radiating element to provide selective filtering, the multi-layer grid including a plurality of panels, each panel defining a layer and including:

a first outer film;

an isotropic foam spacer bonded to the first outer film; and a first adhesive layer for bonding the foam spacer to the first outer film;

a second outer film bonded to the foam spacer opposite the first outer film; and a second adhesive layer for bonding the foam spacer to the second outer film; and a spacer inserted between each pair of panels of the plurality, the spacer integrates the first and second adhesive layers.

10. The antenna of claim 9 wherein the foam spacer comprises one of polymethacrylimide foam and ceramic foam.

11. The antenna of claim 9 wherein the foam spacer comprises a foam material of uniform cross-section.

12. The antenna of claim 9 wherein the first and second adhesive layers comprise polycyanate film.

13. The antenna of claim 9 wherein the spacer is rigid.

14. The antenna of claim 9 further comprising a conducive grid disposed on the second outer film for providing a frequency rejection band.

15. A multi-layer grid for a frequency selective surface filter of an antenna comprising:

a plurality of panels, each panel defining a layer and including:

a first outer film;

an isotropic foam spacer bonded to the first outer film, the foam spacer being of uniform cross-section;

a first adhesive layer for bonding the foam spacer to the first outer film, the first adhesive layer being a polycyanate film adhesive;

a second outer film bonded to the foam spacer opposite the first outer film;

a second adhesive layer for bonding the foam spacer to the second outer film, the second adhesive layer being a polycyanate film adhesive; and a rigid spacer inserted between each pair of panels of the plurality, the rigid spacer integrates the first and second layers via the second outer film of each panel.

16. The multi-layer grid of claim 15 wherein the isotropic foam spacers comprise one of polymethacrylimide foam and ceramic foam.

17. A method of forming a multi-layer grid for a frequency selective surface filter of an antenna comprising the steps of:

fabricating a plurality of panels, each panel defining a layer and fabricated by:

providing a first outer film;

bonding an isotropic foam spacer to the first outer film utilizing a first adhesive layer;

providing a second outer film;

bonding the foam spacer opposite the first outer film utilizing a second adhesive layer; and inserting a spacer between each pair of panels of the plurality, the spacer integrates the first and second layers.

* * * * *